US006752567B2

(12) United States Patent
Miyamoto et al.

(10) Patent No.: US 6,752,567 B2
(45) Date of Patent: Jun. 22, 2004

(54) APPARATUS FOR MANAGING DEGREE OF COMPACTION IN A VIBRATORY COMPACT VEHICLE

(75) Inventors: Isamu Miyamoto, Saitama (JP); Shinnosuke Tanaka, Kanagawa (JP)

(73) Assignee: Sakai Heavy Industries, Ind., Tokyo (JP)

( * ) Notice: Subject to any disclaimer, the term of this patent is extended or adjusted under 35 U.S.C. 154(b) by 87 days.

(21) Appl. No.: 10/232,537

(22) Filed: Sep. 3, 2002

(65) Prior Publication Data

US 2003/0047003 A1 Mar. 13, 2003

(30) Foreign Application Priority Data

Sep. 5, 2001 (JP) ..... 2001-268911

(51) Int. Cl.[7] ..... E01C 19/28
(52) U.S. Cl. ..... 404/84.1; 404/117
(58) Field of Search ..... 340/683, 439, 340/440, 444; 180/20, 21; 701/50; 700/151; 702/142, 145, 149; 404/84.05, 84.1, 84.2, 84.5, 84.8, 117

(56) References Cited

U.S. PATENT DOCUMENTS 3,599,543 A * 8/1971 Kerridge ..... 404/117
4,149,253 A * 4/1979 Paar et al. ..... 701/50
4,330,738 A * 5/1982 Paramythioti et al. ..... 318/128
4,870,601 A * 9/1989 Sandstrom ..... 702/43
5,177,415 A * 1/1993 Quibel et al. ..... 318/128
5,695,298 A * 12/1997 Sandstrom ..... 404/72
5,719,338 A * 2/1998 Magalski et al. ..... 73/660
5,727,900 A * 3/1998 Sandstrom ..... 404/84.1
5,781,874 A * 7/1998 Troppman et al. ..... 701/50
5,942,679 A * 8/1999 Sandstrom ..... 73/78
6,055,486 A * 4/2000 Minnich et al. ..... 702/56
6,065,904 A * 5/2000 Cook et al. ..... 405/303
6,558,072 B2 * 5/2003 Staffenhagen et al. ..... 404/117

FOREIGN PATENT DOCUMENTS

DE 10212389 A1 * 11/2002 ..... E02F/9/00
WO WO 97/15726 5/1997

* cited by examiner

*Primary Examiner*—Thomas B. Will
*Assistant Examiner*—Alexandra K. Pechhold
(74) *Attorney, Agent, or Firm*—Sughrue Mion, PLLC

(57) ABSTRACT

An apparatus for managing degree of compaction includes: a sensor 13 which senses a traveling speed of the vehicle; a switch 14 by which a number of vibrations of the roll transmitted per unit time is set; a reference vibration number setting section 15 by which a reference number of vibrations of the roll transmitted per unit of longitudinal travel of the vehicle is set; an input/output calculating section 16 controlling electric signals outputted from the sensor 13, the switch 14, and the reference vibration number setting section 15, respectively; and a monitor section 17 relatively and comparatively indicating, as a vehicle speed index value, magnitude relation of a current number of vibrations of the roll transmitted per unit of longitudinal travel of the vehicle relative to the reference number of vibrations of the roll on the basis of an electric signal outputted from the input/output calculating section 16.

10 Claims, 10 Drawing Sheets

APPARATUS FOR MANAGING DEGREE OF COMPACTION IN A VIBRATORY COMPACT VEHICLE

FIELD OF THE INVENTION

The present invention relates to an apparatus for managing degree of compaction in a vibratory compacting vehicle.

BACKGROUND OF THE INVENTION

As a prior art apparatus for managing degree of compaction in a vibratory compacting vehicle, one known apparatus is constructed such that the acceleration of the roll in the vertical directions, which occurs when the roll strikes the ground, is detected and utilized to manage the degree of compaction of the ground. Such acceleration information is indicated, for example, on an instrument panel provided at the driver seat. However, this prior art apparatus is complicated in structure because parts such as an acceleration sensor are arranged in the roll. Also, in the case of adjusting the traveling speed of the vehicle on the basis of the acceleration information, it is difficult for an immature operator to determine instantly whether the current traveling speed is corresponding to, or too fast or too slow against the optimum traveling speed at which the most efficient compaction is achieved, or how much is the difference between the current traveling speed and the optimum traveling speed.

In view of the above, International patent Application PCT/US96/16872 (published under WO97/15726) discloses an apparatus for providing an indication of compaction in a vibration compaction vehicle. The outline of the apparatus is described below with reference to FIG. 13.

As seen in FIG. 13, a first electric signal from a speed sensor 71 that senses the traveling speed of the vehicle is transmitted to means 72 for converting the first electric signal into a distance of longitudinal travel per unit time of the vehicle (electric signal-to-distance converter) and the converted electric signal is outputted to a vibratory impact amount calculator 73. A second electric signal from a vibration sensor 74 that senses the number of vibrations of the roll is transmitted to means 75 for converting the second electric signal into the number of vibratory impacts (number of vibrations) per unit time (electric signal-to-number of vibrations converter) and the converted electric signal is outputted to the vibratory impact amount calculator 73. The vibratory impact amount calculator 73 calculates these two electric signals, produces an electric signal corresponding to the number of vibrations transmitted per unit of longitudinal travel of the vehicle, and outputs the produced electric signal to an indicator 76 provided at the driver seat.

The indicator 76 is provided with scale markings of absolute value in relation to the number of vibrations transmitted per unit of longitudinal travel of the vehicle, so that with the indicating pointer 76*a* indicating the scale markings the operator realizes the number of vibrations transmitted per unit of longitudinal travel of the vehicle in the current travel. If the indicator 76 is provided with scale markings indicating the number of vibrations per foot and if the supervisor determines that the optimum number of vibrations per foot, at which the most efficient compaction is achieved, is "10" for the ground, the operator adjusts the traveling speed of the vehicle such that the indicating pointer 76*a* always points at "10" of the scale markings.

However, this apparatus has the following drawbacks. That is, since two sensors such as the speed sensor 71 and the vibration sensor 74 are required, the whole apparatus becomes complicated in structure. Further, since the value indicated on the indicator 76 represents the number of vibrations transmitted per unit of longitudinal travel of the vehicle, it is difficult for an immature operator to comprehend instantly the relation between the current traveling speed of the vehicle and the optimum traveling speed for the ground.

The value indicated on the indicator 76 represents the number of vibrations transmitted per unit of longitudinal travel of the vehicle, that is, an absolute value. The operator thus remembers the absolute value during the operation. However, the optimum number of vibrations transmitted per unit of longitudinal travel of the vehicle is different for each mixture condition of the ground materials, etc., and the operator has to comprehend absolute values for different mixture conditions, which is tedious and may cause a possibility in mixing up with different values by mistake during the operation. Especially, if the operation is carried out in the same work site over an extended time period, in most cases, a plurality of operators works by turns, which may cause a possibility in working with the use of different values unless the determined absolute value is informed thoroughly.

The present invention is made to overcome the aforementioned drawbacks and the purpose thereof is to provide an apparatus for managing degree of compaction in a vibratory compacting vehicle, whereby the operator readily comprehends the optimum traveling speed of the vehicle for each mixture condition of the ground materials.

SUMMARY OF THE INVENTION

According to a first aspect of the present invention, there is provided an apparatus for managing degree of compaction in a vibratory compacting vehicle having a roll to be vibrated comprising: a vehicle speed sensing means which senses a traveling speed of the vehicle; a vibration number setting means by which a number of vibrations of the roll transmitted per unit time is set; a reference vibration number setting means by which a reference number of vibrations of the roll transmitted per unit of longitudinal travel of the vehicle is set; a control means controlling electric signals outputted from the vehicle speed sensing means, the vibration number setting means, and the reference vibration number setting means, respectively; and an indicating means relatively and comparatively indicating, as a vehicle speed index value, magnitude relation of a current number of vibrations of the roll transmitted per unit of longitudinal travel of the vehicle relative to the reference number of vibrations of the roll transmitted per unit of longitudinal travel of the vehicle on the basis of an electric signal outputted from the control means.

This structure enables the operator to readily adjust the traveling speed of the vehicle without recognizing a specific numerical value of the reference number of vibrations.

Further, unlike prior art, the vibration sensor sensing the number of vibrations of the roll is not required, which makes it possible to reduce the number of manpower required for the assembly of the apparatus and provide an apparatus for managing degree of compaction in simple structure.

According to a second aspect of the invention, the control means of the aforementioned apparatus may include: a vibration number calculating section calculating an electric signal outputted from the vehicle speed sensing means and an electric signal outputted from the vibration number setting means to work out a current number of vibrations of the roll transmitted per unit of longitudinal travel of the vehicle; and a vibration number comparing section comparatively calculating the current number of vibrations of the roll transmitted per unit of longitudinal travel of the vehicle that is calculated by the vibration number calculating section and the reference number of vibrations of the roll transmitted per unit of longitudinal travel of the vehicle that is set by the reference vibration number setting means.

According to a third aspect of the invention, the control means of the aforementioned apparatus may include: a vehicle speed calculating section calculating an electric signal outputted from the vehicle speed sensing means to work out a current vehicle speed; a reference vehicle speed calculating section calculating an electric signal outputted from the vibration number setting means and an electric signal outputted from the reference vibration number setting means to work out a reference vehicle speed; and a vehicle speed comparing section comparatively calculating the current vehicle speed worked out by the vehicle speed calculating section and the reference vehicle speed worked out by the reference vehicle speed calculating section.

These structures enable the control means to be simple in structure, which makes it possible to provide an apparatus for managing degree of compaction at lower cost.

According to a fourth aspect of the invention, the aforementioned apparatus may further comprise a non-volatile memory which stores the reference number of vibrations of the roll transmitted per unit of longitudinal travel of the vehicle to be set by the reference vibration number setting means.

In this structure of the apparatus, there is no need to reset the reference number of vibrations on a daily basis before initiating the operation.

According to a fifth aspect of the invention, the aforementioned apparatus may further comprise an engine speed sensing means which directly or indirectly senses a number of revolutions of an engine mounted on the vehicle, and wherein said control means controls an electric signal outputted from the engine speed sensing means.

In this structure of the apparatus, vehicle information can be indicated accurately without errors on the indicating means throughout the whole engine speed bands.

BRIEF DESCRIPTION OF THE DRAWINGS

Preferred embodiments of the present invention will be described below, by way of example only, with reference to the accompanying drawings, in which.

DESCRIPTION OF THE PREFERRED EMBODIMENTS

Figure 1:
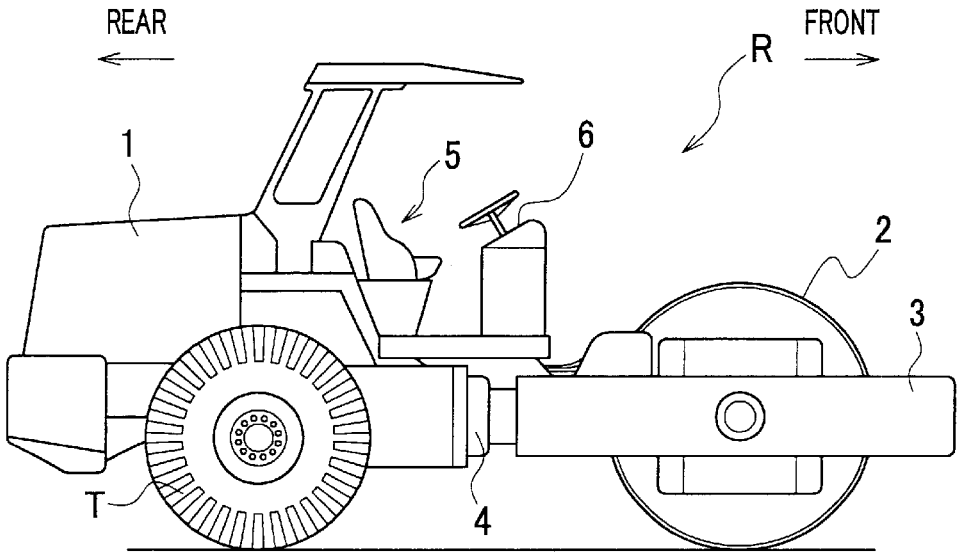
FIG. 1 is a side elevation view explaining one example of a vibratory compacting vehicle.

Preferred embodiments of the invention will be described with reference to the attached drawings. FIG. 1 is a side elevation view explaining one example of a vibratory compacting vehicle. As shown in the figure, the vibratory compacting vehicle R is a vibratory roller mainly used for compacting an irregular ground. This vibratory roller includes a vehicle body 1 having a pair of tire wheels T at both sides thereof, and a frame body 3 axially supporting a roll 2 at the front side of the vehicle body 1 and in the form of rectangle when viewed from top. The vehicle body 1 and the frame body 3 are articulately joined at a connecting portion 4. A driver seat 5 is provided on top of the vehicle body 1. A known vibration device (not shown) having a structure that is driven by a hydraulic motor and the like (e.g., structure for rotating a shaft on which is mounted an eccentric weight) is accommodated in the roll 2. When the operator turns on the switch at an instrument panel 6 provided at the driver seat 5, the vibration device is actuated and the roll 2 compacts the ground while being vibrated.

Figure 2:
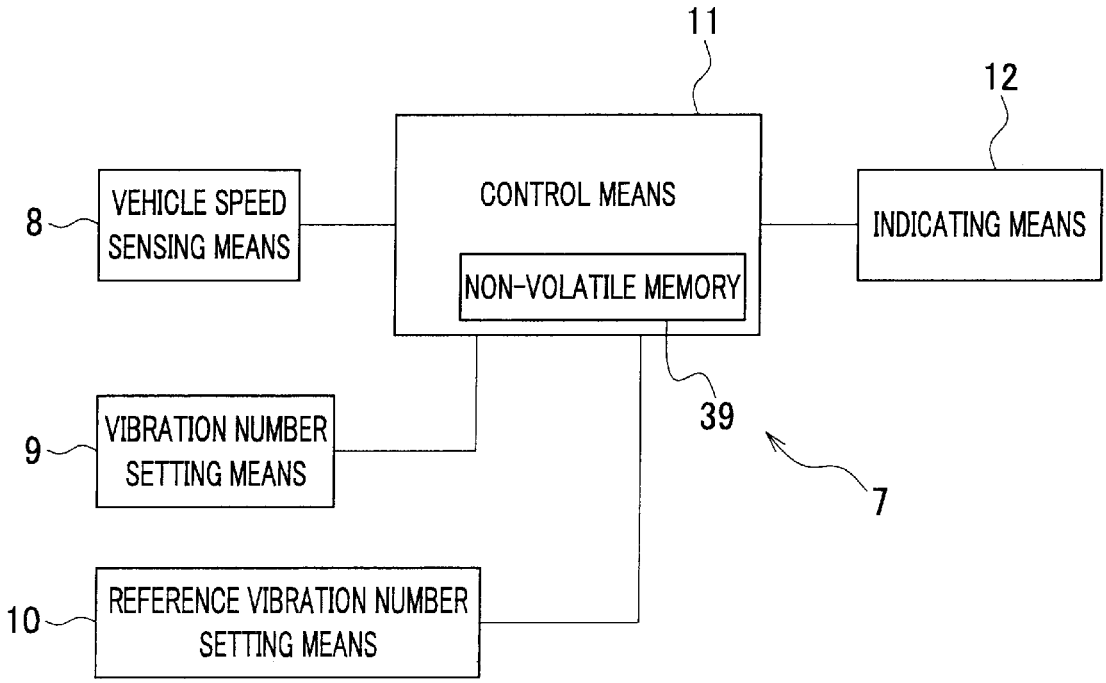
FIG. 2 is a block diagram showing the structure of an apparatus for managing degree of compaction according to the invention.

As seen in FIG. 2, an apparatus 7 for managing degree of compaction according to the invention includes: a vehicle speed sensing means 8 which senses the traveling speed of the vehicle; a vibration number setting means 9 by which the number of vibrations of the roll 2 transmitted per unit time is set; a reference vibration number setting means 10 by which a reference number of vibrations of the roll 2 transmitted per unit of longitudinal travel of the vehicle is set; a control means 11 controlling electric signals outputted from the vehicle speed sensing means 8, the vibration number setting means 9, and the reference vibration number setting means 10, respectively; and an indicating means 12 relatively and comparatively indicating, as a vehicle speed index value (vehicle speed information), magnitude relation of the current number of vibrations (actual number of vibrations during the travel) of the roll 2 transmitted per unit of longitudinal travel of the vehicle relative to the reference number of vibrations of the roll 2 transmitted per unit of longitudinal travel of the vehicle on the basis of an electric signal outputted from the control means 11.

As preferred embodiments of the present invention, the following describes two embodiments wherein the differences thereof mainly rely on the structure of the control means 11.

First Embodiment

Figure 3A:
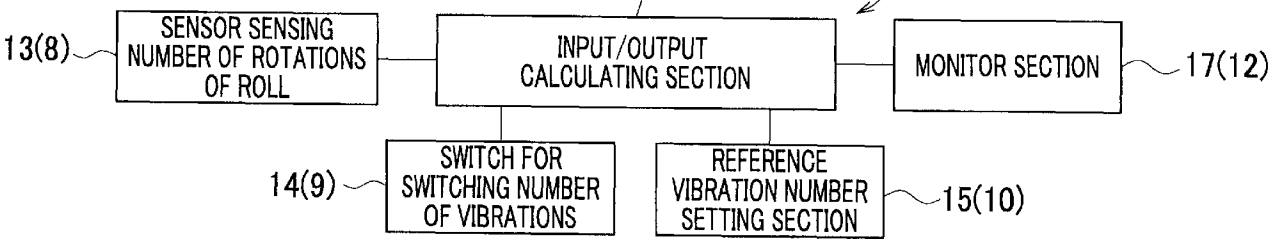
FIGS. 3A through 3C are block diagrams showing the structures of an apparatus for managing degree of compaction according to a first embodiment of the invention.
Figure 4:
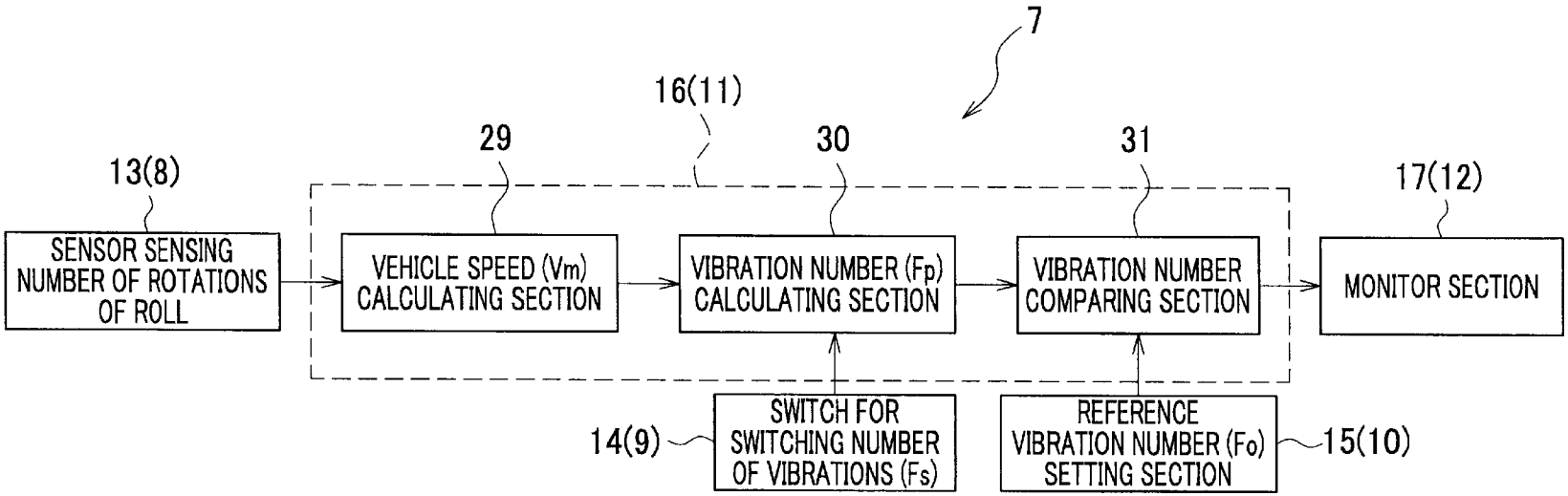
FIG. 4 is a system block diagram showing an apparatus for managing degree of compaction according to the first embodiment of the invention.
Figure 5:
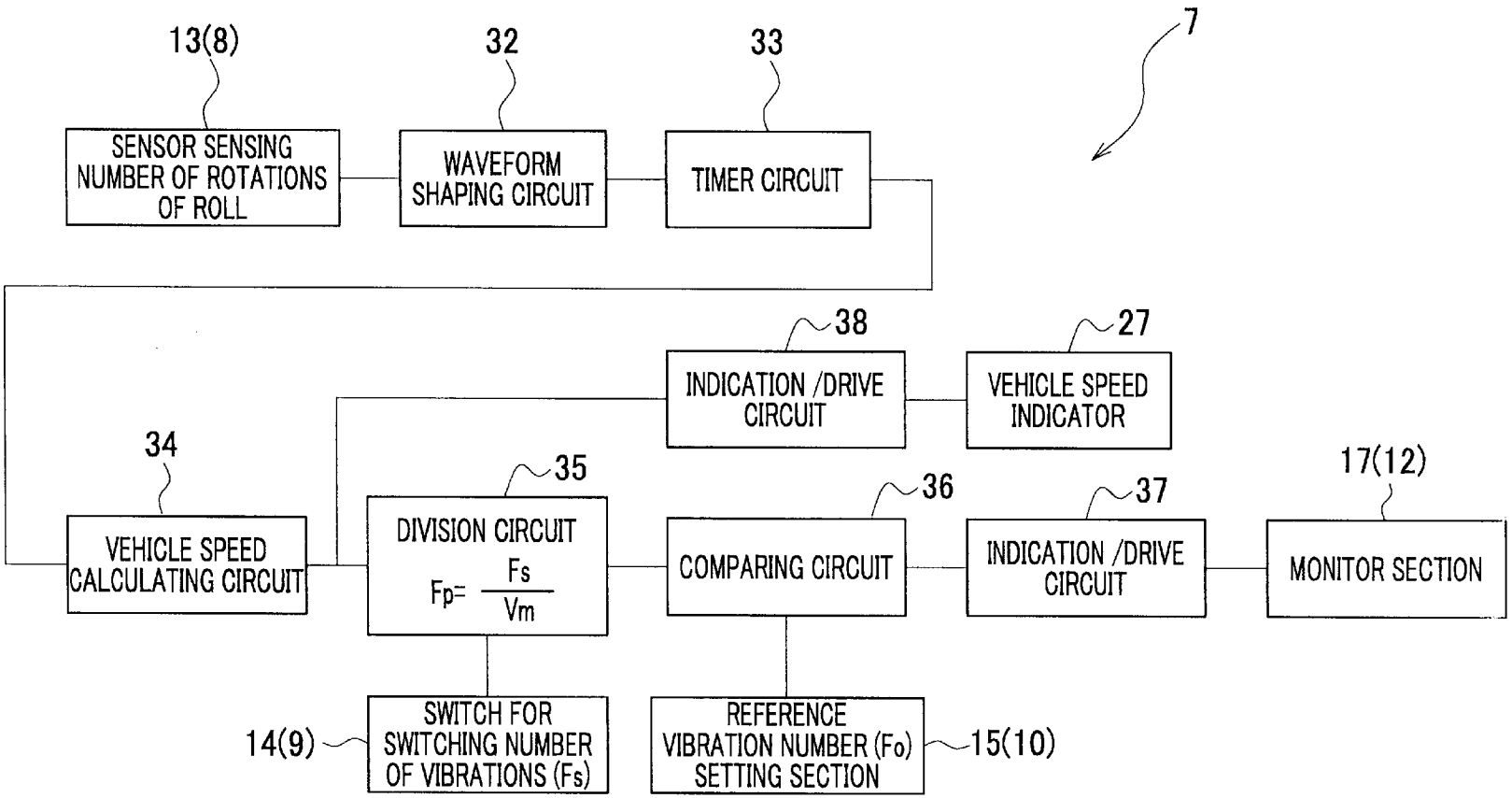
FIG. 5 is a system circuit block diagram showing an apparatus for managing degree of compaction according to the first embodiment of the invention.

FIG. 3A, FIG. 4, and FIG. 5 respectively show a block diagram showing the structure, a system block diagram, and a system circuit block diagram, according to the first embodiment of the invention. In FIG. 3A, the apparatus 7 for managing degree of compaction includes: a sensor 13 sensing the number of rotations of the roll 2 that is associated with the vehicle speed sensing means 8; a switch 14 for switching the number of vibrations that is associated with the vibration number setting means 9; a reference vibration number setting section 15 that is associated with the reference vibration number setting means 10; an input/output calculating section 16 that is associated with the control means 11; and a monitor section 17 that is associated with the indicating means 12.

Sensor 13 Sensing the Number of Rotations of the Roll (Vehicle Speed Sensing Means 8)

Figure 9A:
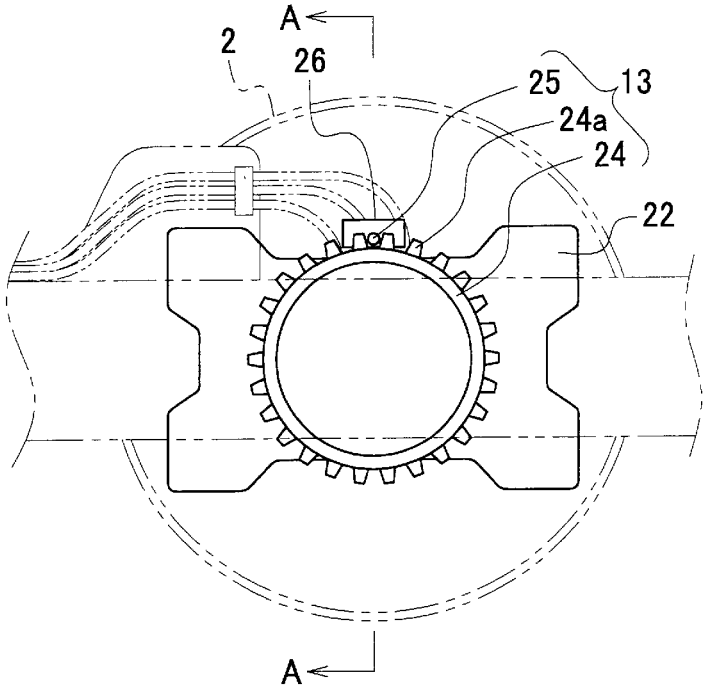
FIG. 9A is a side explanatory view of a sensor sensing the number of rotations of the roll.
Figure 9B:
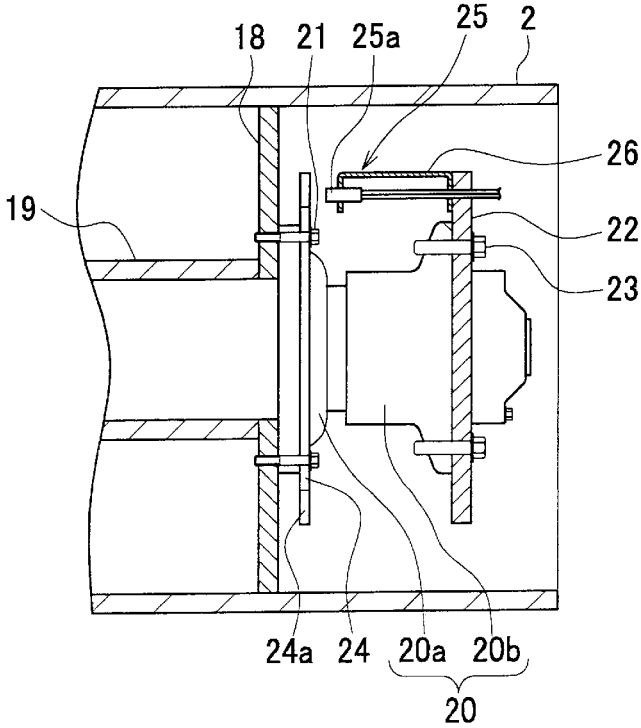
FIG. 9B is a sectional view taken along the line A—A of FIG. 9A.

FIG. 9A is a side explanatory view of a sensor sensing the number of rotations of the roll, and FIG. 9B is a sectional view taken along the line A—A of FIG. 9A. The roll 2 is in the form of a hollow tube, and a pair of disk-shaped end plates 18 (one endplate 18 is not shown in FIG. 9B) is fixed to the inner peripheral surface of the roll 2. A vibration generating device case 19 in the form of a hollow tube is positioned between the pair of end plates 18 and fixed concentrically with the roll 2. The non-illustrated vibration device is accommodated in the vibration generating device case 19. An output portion 20*a* of a hydraulic traveling motor 20 is fixed to the outer surface of the end plate 18 by bolts 21. A stationary portion 20*b* of the hydraulic traveling motor 20 is stationarily fixed to a support plate 22 by bolts 23. The support plate 22 is fixed to the side surface of the frame body 3 via a non-illustrated rubber vibration isolator and a non-illustrated bracket. The roll 2 starts to travel when the output portion 20*a* rotates relative to the stationary portion 20*b*.

The sensor 13 sensing the number of rotations of the roll 2 consists of a detected member 24 and a detecting sensor 25. The detected member 24 is in the form of a ring, and provided radially at the outer periphery of the detected member 24 is a plurality of equidistant projections 24*a*. The detected member 24 is fixed, together with the output portion 20*a* of the hydraulic traveling motor 20, to the end plate 18 by bolts 21 in such a manner that the detected member 24 and the output portion 20*a* are positioned concentrically with the roll 2. Meanwhile, the detecting sensor 25 is fixed to the support plate 22 through a bracket 26 in such a manner that a sensing portion 25*a* of the detecting sensor 25 positioned oppositely to the projections 24*a* of the detected member 24 with a slight gap. The detecting sensor 25 is not limited to a specific type sensor, and may be of any known type such as optical or magnetic type. With the above structure, when the detected member 24 is rotated with the rotation of the roll 2, the detecting sensor 25 senses the number of the projections 24*a* passed across the sensing region thereof and detects the number of rotations of the roll 2.

Switch 14 for Switching the Number of Vibrations (Vibration Number Setting Means 9)

Figure 10:
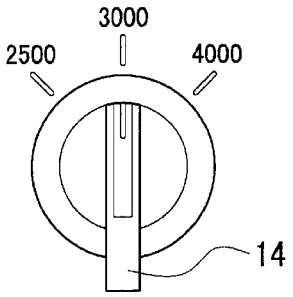
FIG. 10 is an explanatory view illustrating one example of a switch for switching the number of vibrations.

FIG. 10 illustrates one example of a switch 14 for switching the number of vibrations. In this example, the switch 14 is a manually operated rotary type switch that is provided at the instrument panel 6 of the driver seat 5, and as the number of vibrations of the roll 2 per unit time, the switch 14 is switchable for three stages of vibrations (unit: vpm), that is, 2500, 3000, and 4000 vibrations per minute. The function for switching the number of vibrations is effective to carry out an excellent compaction for various mixture conditions of the ground materials, and the number of vibrations is determined and selected in consideration of the mixture conditions and the like of the subject ground materials.

Reference Vibration Number Setting Section 15 (Reference Vibration Number Setting Means 10)

Figure 11:
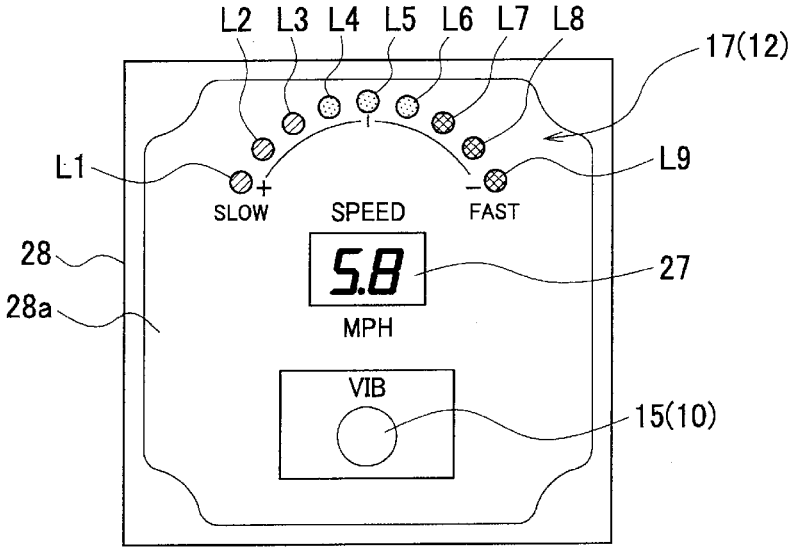
FIG. 11 is an explanatory view illustrating a reference vibration number setting section, a monitor section, and a vehicle speed indicator.

FIG. 11 illustrates one example of a reference vibration number setting section 15. In this example, together with the control means 11, a monitor section 17 (indicating means 12), and a vehicle speed indicator 27 to be described later, the reference vibration number setting section 15 is incorporated in a casing 28 as a unit. FIG. 11 shows a front panel 28*a* of the casing 28. The casing 28 is arranged, for example, such that the front panel 28*a* is laid out on the instrument panel 6 of the driver seat 5.

The reference vibration number setting section 15 of FIG. 11 is shown as a manually operated push button-type switch, and by pressing the switch with a finger the set value is in turn changed to 1, 2, 3, 4 . . . and the like. The set value is indicated by the vehicle speed indicator 27 consisting of LED segments and the like. To be more specific, the set value is indicated for a few seconds (e.g., 5 seconds) after the operator sets the desired set value and releases his finger from the switch, and is automatically faded out. When continuously pressing the switch and the setting value reaches the maximum value, the setting value again starts from "1".

The unit for the setting value is "the number of vibrations of the roll transmitted per unit of longitudinal travel of the vehicle", and in this preferred embodiment, utilizes the number of vibrations of the roll per foot. In order to clearly define the value set by the reference vibration number setting section 15, the term "the number of vibrations of the roll transmitted per unit of longitudinal travel of the vehicle" is used throughout the specification. The set value is appropriately determined in consideration of the mixture conditions of the subject ground materials, the axle road of the vehicle, and the like.

Figure 12:
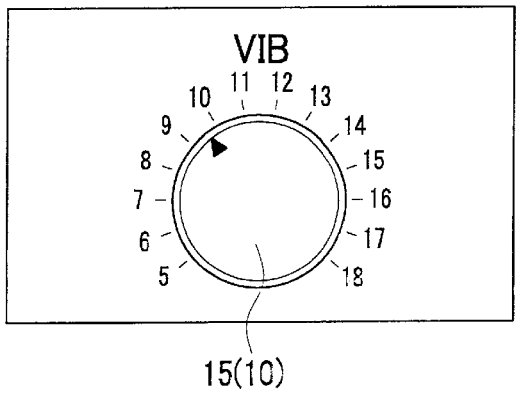
FIG. 12 is an explanatory view illustrating a modification of the reference vibration number setting section.
Figure 13:
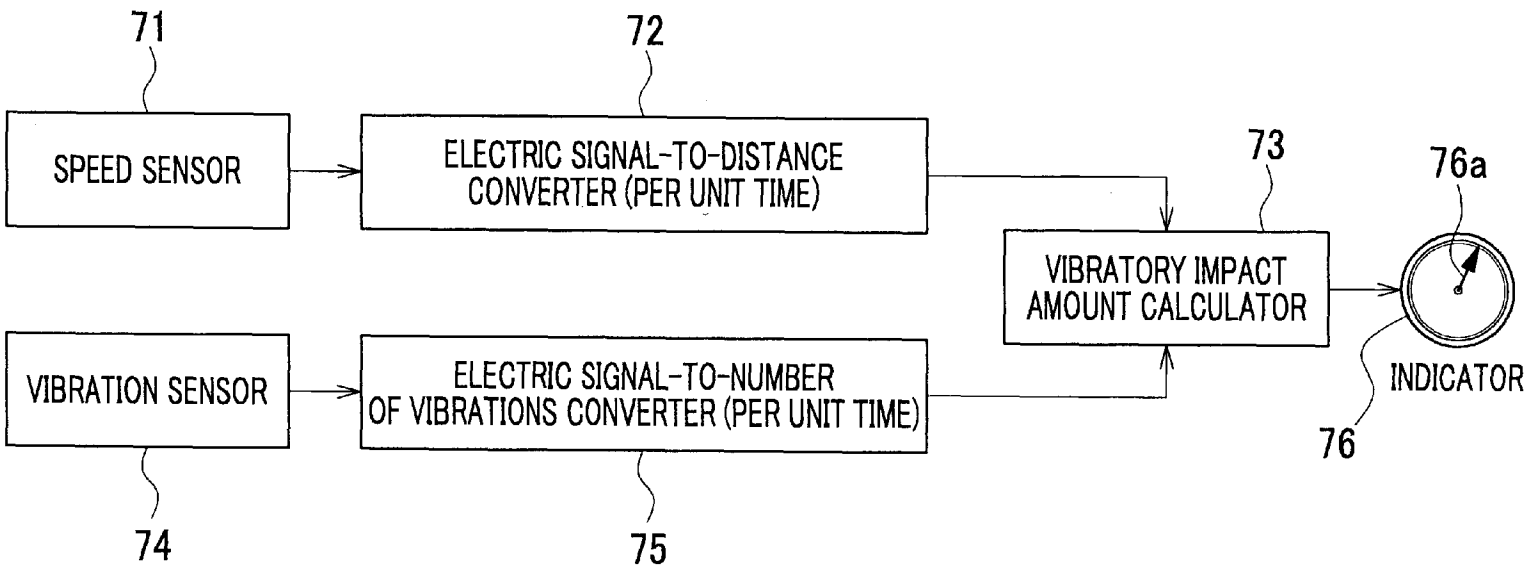
FIG. 13 PRIOR ART
FIG. 13 is a block diagram showing the structure of a prior art apparatus for managing degree of compaction.

FIG. 12 illustrates a modified example of the reference vibration number setting section 15, in which the switch is shown as a rotary type. In this example, since various setting values are indicated on the front panel 28*a*, there is no need to electrically indicate the value like the aforementioned vehicle speed indicator 27, which is more economical in cost.

Input/Output Calculating Section 16 (Control Means 11)

In FIG. 3A, the sensor 13 sensing the number of rotations of the roll 2 outputs a certain electric signal corresponding to the number of rotations of the roll 2. The switch 14 for switching the number of vibrations outputs a certain electric signal corresponding to the number of vibrations of the roll 2 transmitted per unit time, and the reference vibration number setting section 15 outputs a certain electric signal corresponding to the reference number of vibrations of the roll 2 transmitted per unit of longitudinal travel of the vehicle. These three electric signals are inputted into the input/output calculating section 16. The input/output calculating section 16 carries out calculation and then outputs a certain electric signal to the monitor section 17 (indicating means 12).

With reference to FIGS. 4 and 5, the outline process to carry out the calculation will be described. In FIG. 4, an electric signal outputted from the sensor 13 is subjected to a calculation at a vehicle speed calculating section 29 to work out a vehicle speed Vm. To be more specific, as best seen in FIG. 5, an electric signal outputted from the sensor 13 is transmitted via a waveform shaping circuit 32 and a timer circuit 33 to a vehicle speed calculating circuit 34 where the calculation is performed. The obtained vehicle speed Vm and the number of vibrations of the roll 2 transmitted per unit time (hereinafter also referred to as the number of vibrations Fs) that is set by the switch 14 are calculated at a vibration number calculating section 30. Specifically, a division circuit 35 shown in FIG. 5 performs a division by dividing the number of vibrations Fs by the vehicle speed Vm to obtain the current number of vibrations of the roll 2 transmitted per unit of longitudinal travel of the vehicle (hereinafter also referred to as the number of vibrations Fp). The above calculation is given by the following equation.

$$Fp=Fs/Vm \quad (1)$$

In other words, the number of vibrations Fp represents the actual number of vibrations of the roll 2 transmitted per unit of longitudinal travel during the travel of the vehicle.

A vibration number comparing section 31 (comparing circuit 36 of FIG. 5) compares the number of vibrations Fp with the reference number of vibrations of the roll 2 per unit of longitudinal travel of the vehicle that is set by the reference vibration number setting section 15 (hereinafter also referred to as the reference number of vibrations Fo), and calculates the difference. As shown in FIG. 5, an electric signal corresponding to this difference is outputted to the monitor section 17 via an indication/drive circuit 37.

Monitor Section 17 (Indicating Means 12)

The monitor section 17 relatively and comparatively indicates, as a vehicle speed index value (vehicle speed information), magnitude relation of the number of vibrations Fp relative to the reference number of vibrations Fo. FIG. 11 illustrates one example of the monitor section 17. A plurality of (nine in this embodiment) LED lamps is arranged at the upper part of the front panel 28*a* of the casing 28. Specifically, if the lamps are in turn referred to as L1, L2, L3, . . . and L9 from the left-side lamp, the lamps are arranged arcuately and equally spaced apart with the middle lamp L5 positioned at the peak. Arranged on the front panel 28*a* and below the monitor section 17 are the letters "SPEED", which indicates that the monitor section 17 concerns vehicle speed index value in relation to the traveling speed of the vehicle. Letters "SLOW" and "FAST" are arranged near the left end lamp L1 and the right end lamp L9, respectively. These letters "SPEED", "FAST", and "SLOW" are not essential. However, when any one of the lamps L1 to L9 is lit, the operator readily recognizes whether the current vehicle speed is faster or slower than the reference number of vibrations Fo. Other letters or symbols indicating the number of vibrations Fp that is in the reciprocal relation of the vehicle speed Vm may be employed.

During the drive of the vehicle, any one of the lamps L1 to L9 is lit. When the vehicle speed is in an appropriate range, that is, when the number of vibrations Fp is almost equal to the reference number of vibrations Fo, the middle lamp L5 is lit. In this instance, the number of vibrations Fp is not necessary to completely equal to the reference number of vibrations Fo, and the lamp L5 may be lit when the number of vibrations Fp is in a certain range relative to the reference number of vibrations Fo, for example, when the value of the number of vibrations Fp is in the range of the reference number of vibrations Fo±1. To be more specific, if the set value of the reference number of vibrations Fo is "12" (as previously described, the unit represents the number of vibrations of the roll per foot), the middle lamp L5 is lit when the number of vibrations Fp during the travel is in the range of 11–13.

When the traveling speed of the vehicle is slower than the reference number of vibrations Fo, that is, when the value of the vehicle speed Vm is small, the value of the number of vibrations Fp becomes greater (the number of vibrations Fs is a fixed value set by the switch 14) as apparent from the equation (1), and thereby any of the lamps L1 to L4 at the "SLOW" side is lit. Of course, the value of the number of vibrations Fp becomes greater as the lighting lamp is closer to the left end lamp L1, which indicates that the traveling speed of the vehicle becomes slower in the left-side lamp. In other words, with respect to the lamp L5 indicating the appropriate traveling speed of the vehicle, the lamps L1 to L4 relatively and comparatively indicate that the traveling speed of the vehicle is slower. When any one of the lamps L1 to L4 is lit, the roll 2 strokes the ground too many times than required in comparison with the set value of the reference number of vibrations Fo that has been set by the reference vibration number setting section 15. As described previously, when any one of the lamps L1 to L4 is lit, the operator seated on the driver seat immediately recognizes that the traveling speed of the vehicle is too slow, and is just required to increase the traveling speed of the vehicle until the middle lamp L5 is lit.

On the contrary, when the traveling speed of the vehicle is faster than the reference number of vibrations Fo, that is, when the value of the vehicle speed Vm is great, the value of the number of vibrations Fp becomes smaller as apparent from the equation (1), and thereby any of the lamps L6 to L9 at the "FAST" side is lit. The value of the number of vibrations Fp becomes smaller as the lighting lamp is closer to the right end lamp L9, which indicates that the traveling speed of the vehicle becomes faster in the right-side lamp. In other words, with respect to the lamp L5 indicating the appropriate traveling speed of the vehicle, the lamps L6 to L9 relatively and comparatively indicate that the traveling speed of the vehicle is faster. When any one of the lamps L6 to L9 is lit, the traveling speed of the vehicle is too fast and the roll 2 strokes the ground fewer times than required in comparison with the set value of the reference number of vibrations Fo that has been set by the reference vibration number setting section 15. As described previously, when any one of the lamps L6 to L9 is lit, the operator immediately recognizes that the traveling speed of the vehicle is too fast, and is just required to decrease the traveling speed of the vehicle until the middle lamp L5 is lit.

According to this preferred embodiment, the lamps L1 to L9 are distinguished by different colors. The middle three lamps L4 to L6 are green emitting lamps as they indicate that the traveling speed of the vehicle is in the appropriate range or close to the appropriate range. The "SLOW" side lamps L1 to L3 are yellow emitting lamps for the purpose of drawing the operator's moderate attention. This is because even if the operation requires a longer period of time due to slower traveling speed of the vehicle, the finished quality of the compacted ground is not deteriorated so much by the increased number of vibrations. The "FAST" side lamps L7 to L9 are red emitting lamps for the purpose of drawing the operator's serious attention. This is because the finished quality of the compacted ground is badly affected by the decreased number of vibrations transmitted per unit of longitudinal travel of the vehicle.

Vehicle Speed Indicator 27

According to the invention, the vehicle speed indicator 27 is employed as an optional part and is not an essential constituent element. However, the vehicle speed indicator 27 is advantageous for the operator to comprehend the traveling speed (absolute value) of the vehicle. As seen in FIG. 11, the vehicle speed indicator 27 is arranged on the front panel 28*a* of the casing 28 below the monitor section 17. The figure illustrates the instance where the vehicle speed indicator 27 is a digital displayed meter comprised of LED segments. As previously described, the vehicle speed indicator 27 also indicates the set value to be set by the reference vibration number setting section 15, however, the traveling speed of the vehicle is indicated in real time during the normal drive of the vehicle. As seen in FIG. 5, an electric signal corresponding to the vehicle speed Vm that has been calculated by the vehicle speed calculating circuit 34 is outputted to the vehicle speed indicator 27 via the indication/drive circuit 37.

As previously described, with the apparatus for managing degree of compaction including: the vehicle speed sensing means 8 which senses the traveling speed of the vehicle; the vibration number setting means 9 by which the number of vibrations (Fs) of the roll 2 transmitted per unit time is set; the reference vibration number setting means 10 by which the reference number of vibrations (Fo) of the roll 2 transmitted per unit of longitudinal travel of the vehicle is set; the control means 11 controlling electric signals outputted from the vehicle speed sensing means 8, the vibration number setting means 9, and the reference vibration number setting means 10, respectively; and the indicating means 12 relatively and comparatively indicating, as a vehicle speed index value (vehicle speed information), magnitude relation of the current number of vibrations (Fp) of the roll 2 transmitted per unit of longitudinal travel of the vehicle relative to the reference number of vibrations (Fo) of the roll 2 transmitted per unit of longitudinal travel of the vehicle on the basis of an electric signal outputted from the control means 11, the following advantages are achieved.

For example, prior to the operation once the supervisor or the like sets the reference number of vibrations Fo that is the most efficient for the work site in consideration of the mixture conditions of the subject ground materials, the working conditions, and the like, it is not necessary for the vehicle operator to remember the specific numerical value of the reference number of vibrations Fo like the conventional operation and the operator can readily adjust the traveling speed of the vehicle, based on the vehicle speed information relatively and comparatively indicated by the indicating means, such that the vehicle speed remains within the optimum indicating range. In the prior art operation, if the optimum value of the reference number of vibrations Fo is "10" for the ground, the operator has to remember the value of "10" during the operation whenever adjustment of the traveling speed is required. And if the optimum value of the reference number of vibrations Fo is "12" for another ground, the operator has to remember the value of "12" during the operation. According to the invention, irrespective of the value of the reference number of vibrations Fo, the indicating means relatively and comparatively indicates the vehicle speed information relative to the optimum vehicle speed, which enables the operator, even for an immature operator, to readily adjust the traveling speed of the vehicle.

Further, unlike the prior art apparatus the vibration sensor sensing the number of vibrations of the roll (detecting sensor for sensing the number of rotations of the hydraulic vibration motor, etc.) is not necessary. Therefore, the number of manpower required for the assembly of the apparatus is decreased, leading to provision of an apparatus for managing degree of compaction in simple structure.

As shown in FIG. 2, if the apparatus is equipped with a non-volatile memory 39 which stores the reference number of vibrations Fo to be set, even if the operation is carried out in the same work site for many days, there is no need to reset the reference number of vibrations Fo on a daily basis before initiating the operation.

As shown in FIG. 4, the control means 11 becomes simple in structure if the control means 11 includes: the vibration number calculating section 30 calculating an electric signal outputted from the vehicle speed sensing means 8 and an electric signal outputted from the vibration number setting means 9 to work out the current number of vibrations (Fp) of the roll transmitted per unit of longitudinal travel of the vehicle; and the vibration number comparing section 31 comparatively calculating the current number of vibrations Fp that is calculated by the vibration number calculating section 30 and the reference number of vibrations Fo of the roll transmitted per unit of longitudinal travel of the vehicle that is set by the reference vibration number setting means 10.

In the above apparatus 7 for managing degree of compaction, the number of vibrations Fs (2500, 3000, and 4000 vpm), which is set by the switch 14 for switching the number of vibrations (vibration number setting means 9), is generated on condition that the engine speed of the vehicle is set to a constant number of revolutions (normally the maximum value). Adjustment of the engine speed is normally carried out by operating the inclinable throttle lever (not shown) provided at the driver seat. In this instance, if the operator fails to increase the engine speed to the maximum value, the actual number of vibrations Fs generated at the roll is different from the number of vibrations Fs set by the switch 14, which may cause an error on the vehicle speed information indicated by the indicating means 12.

Figure 3B:
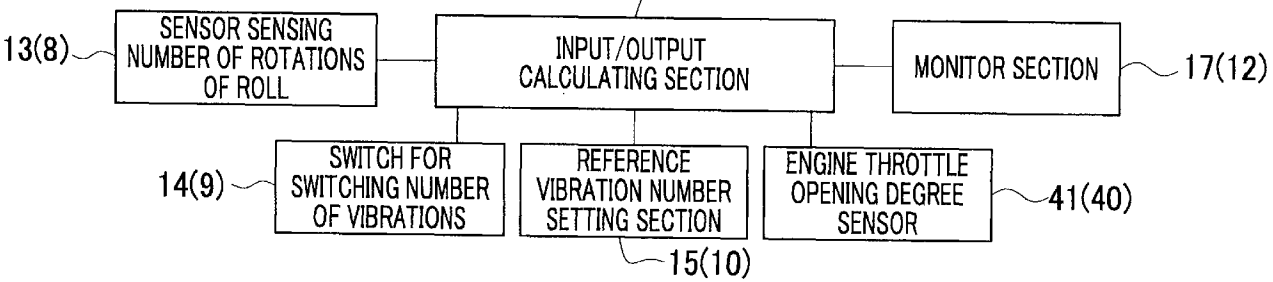
Figure 3C:
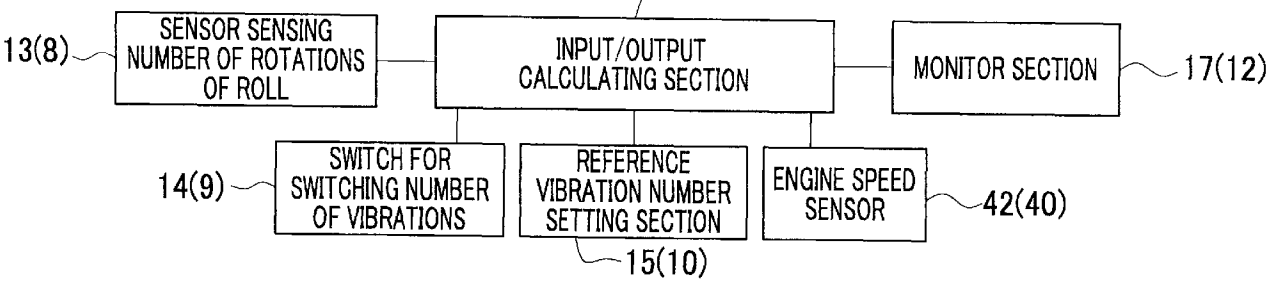

For this reason, the apparatus may further include an engine speed sensing means 40 which directly or indirectly senses the engine speed (number of revolutions of the engine), so that in consideration of information concerning the engine speed, accurate vehicle information can be indicated on the indicating means 12 throughout the whole engine speed bands. FIG. 3B shows an instance where the engine speed sensing means 40 is formed by an engine throttle opening degree sensor 41. The engine throttle opening degree sensor 41 detects the opening degree (inclination degree) of the throttle lever, which indirectly makes it possible to take out an electric signal corresponding to the engine speed. This electric signal is outputted to the input/output calculating section 16, and by correcting errors of the electric signal corresponding to the number of vibrations Fs the actual number of vibrations Fs generated at the roll can be obtained. FIG. 3C shows an instance where the engine speed sensing means 40 is formed by an engine speed sensor 42. An electric signal from the engine speed sensor 42 is outputted to the input/output calculating section 16, and by correcting errors of the electric signal corresponding to the number of vibrations Fs the actual number of vibrations Fs generated at the roll can be obtained.

Second Embodiment

Figure 6A:
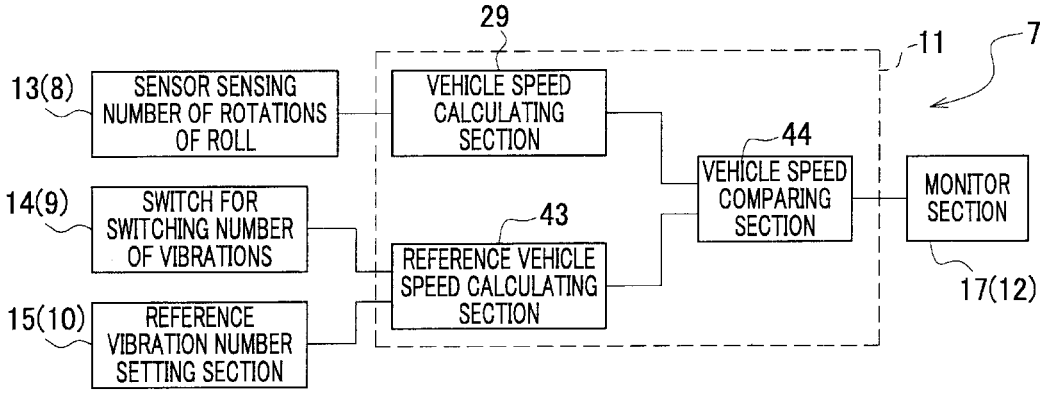
FIGS. 6A through 6C are block diagrams showing the structures of an apparatus for managing degree of compaction according to a second embodiment of the invention.
Figure 7:
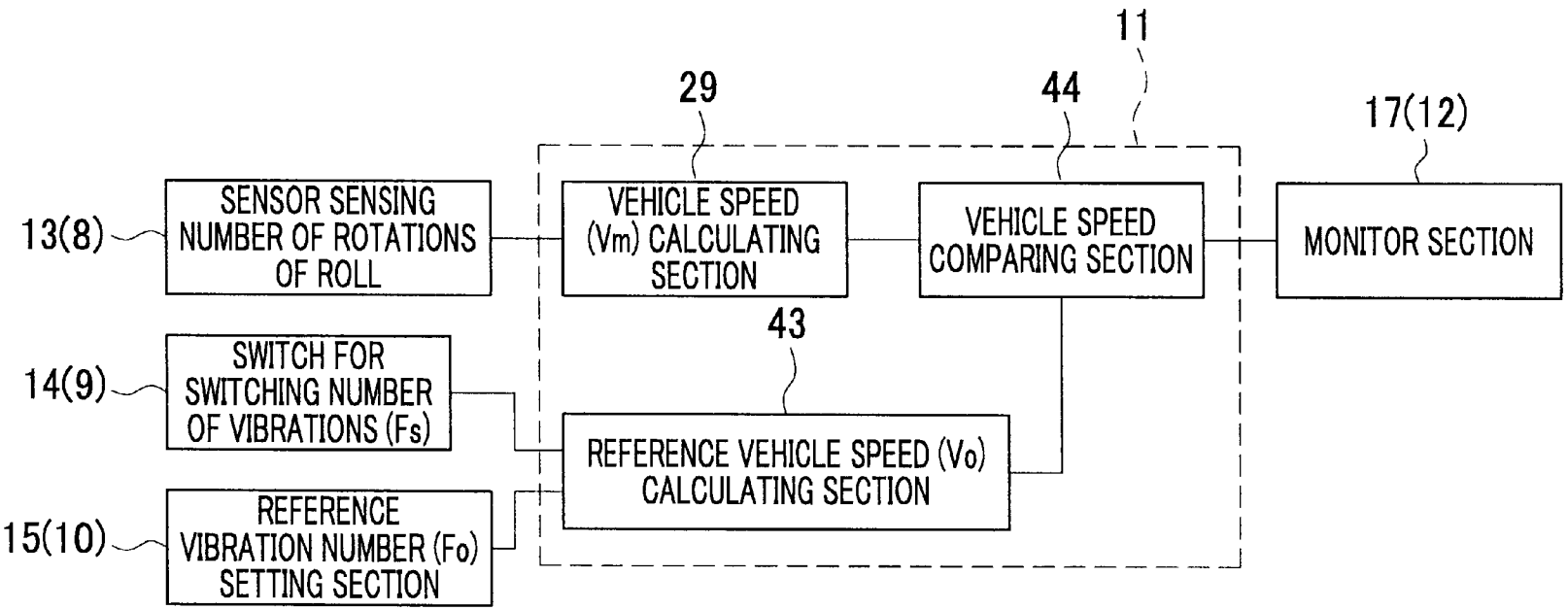
FIG. 7 is a system block diagram showing an apparatus for managing degree of compaction according to the second embodiment of the invention.
Figure 8:
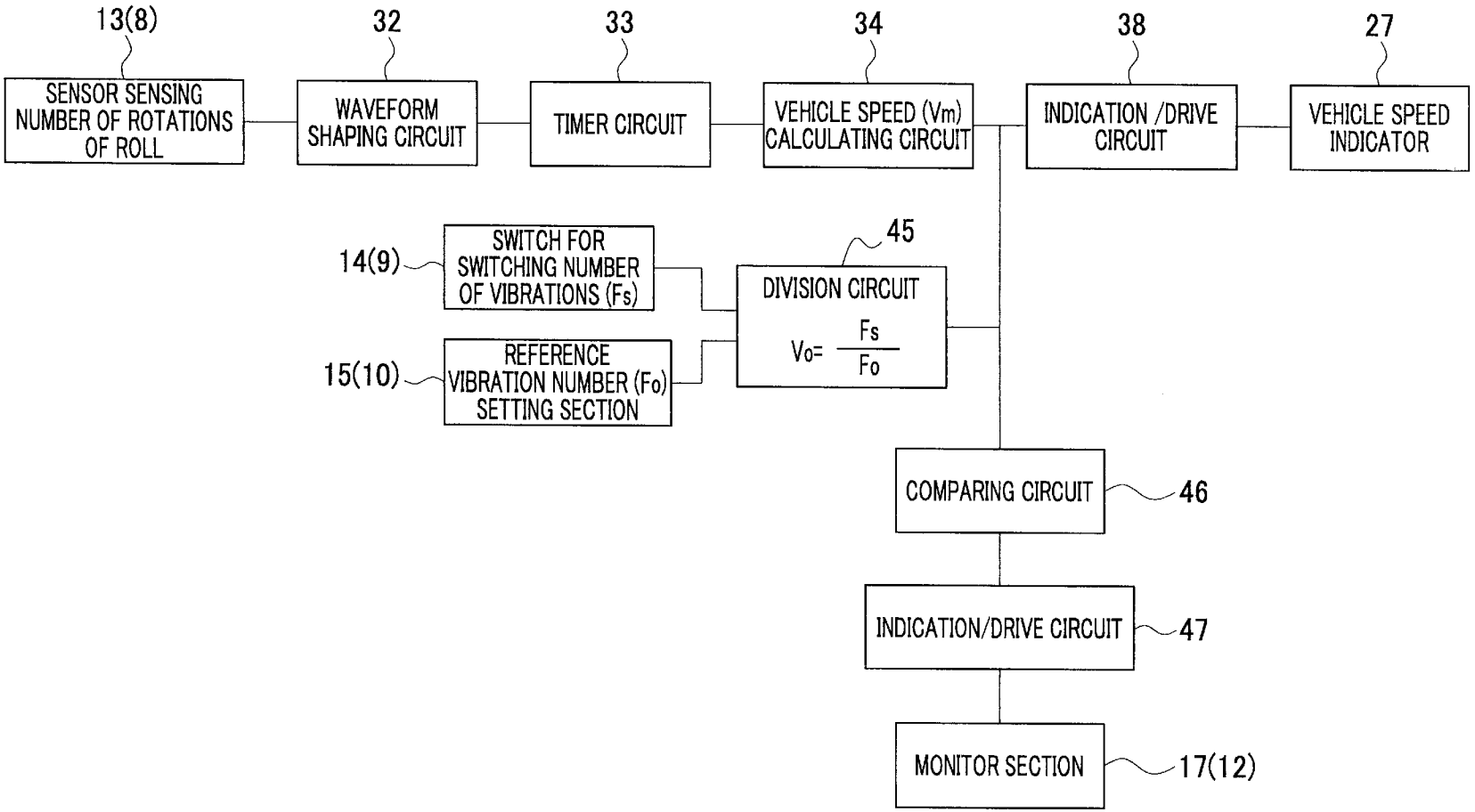
FIG. 8 is a system circuit block diagram showing an apparatus for managing degree of compaction according to the second embodiment of the invention.

A second embodiment of the invention will be described. The second embodiment is substantially the same as the first embodiment except for the control means 11. Only the configuration different from the first embodiment is discussed below, and the constituents identical with those of the first embodiment are shown by the same numerals and are not specifically described here. FIGS. 6A, 7, and 8 respectively show a block diagram, a system block diagram, and a system circuit block diagram of the second embodiment.

In FIG. 6A, the control means 11 includes: a vehicle speed calculating section 29 calculating an electric signal outputted from the sensor 13 sensing the number of rotations of the roll 2 (vehicle speed sensing means 8) to work out the current vehicle speed; a reference vehicle speed calculating section 43 calculating an electric signal outputted from the switch 14 for switching the number of vibrations (vibration number setting means 9) and an electric signal outputted from the reference vibration number setting section 15 (reference vibration number setting means 10) to work out a reference vehicle speed; and a vehicle speed comparing section 44 comparatively calculating the current vehicle speed worked out by the vehicle speed calculating section 29 and the reference vehicle speed worked out by the reference vehicle speed calculating section 43. The vehicle speed calculating section 29 according to the second embodiment is the same as that of the first embodiment.

With reference to FIGS. 7 and 8, the outline process to carry out the calculation will be described. In FIG. 7, an electric signal outputted from the sensor 13 is subjected to a calculation at the vehicle speed calculating section 29 to work out a vehicle speed Vm. To be more specific, as best seen in FIG. 8, an electric signal outputted from the sensor 13 is transmitted via a waveform shaping circuit 32 and a timer circuit 33 to a vehicle speed calculating circuit 34 where the calculation is performed. As shown in FIG. 8, an electric signal corresponding to the number of vibrations (Fs) of the roll 2 transmitted per unit time that is set by the switch 14 and an electric signal corresponding to the reference number of vibrations (Fo) of the roll 2 transmitted per unit of longitudinal travel of the vehicle that is set by the reference vibration number setting section 15 are calculated at a division circuit 45. In other words, the number of vibrations Fs is divided by the reference number of vibrations Fo to work out the reference vehicle speed Vo. The above calculation is given by the following equation.

$$Vo=Fs/Fo \tag{2}$$

The vehicle speed comparing section 44 shown in FIG. 7 (comparing circuit 46 of FIG. 8) compares the current vehicle speed Vm calculated by the vehicle speed calculating section 29 with the reference vehicle speed Vo, and calculates the difference. As shown in FIG. 8, an electric signal corresponding to this difference is outputted to the monitor 17 via an indication/drive circuit 47.

According to the first embodiment, the number of vibrations Fp and the reference number of vibrations Fo are compared to calculate the difference, and the electric signal corresponding to this difference is outputted to the monitor 17. Meanwhile, according to the second embodiment, the current vehicle speed Vm and the reference vehicle speed Vo are compared to calculate the difference, and the electric signal corresponding to this difference is outputted to the monitor 17, which enables the control means 11 to be simple in structure.

Figure 6B:
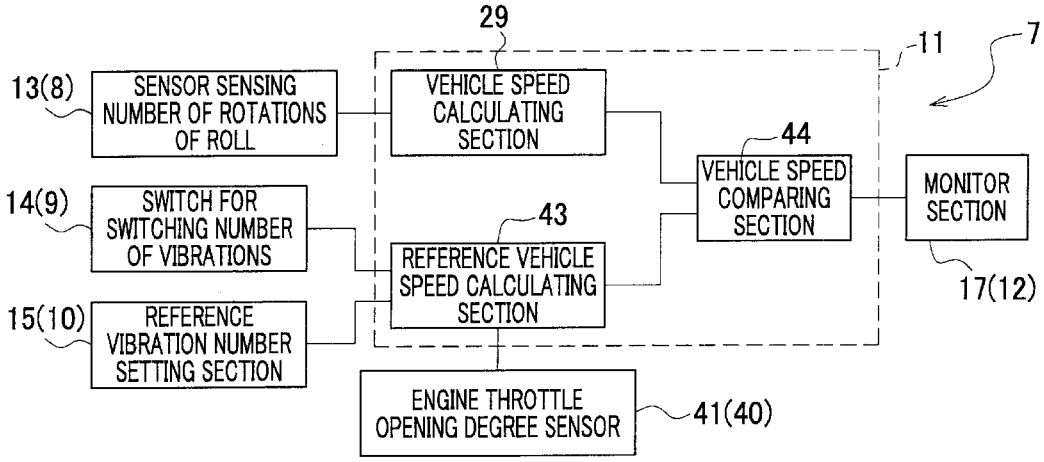
Figure 6C:
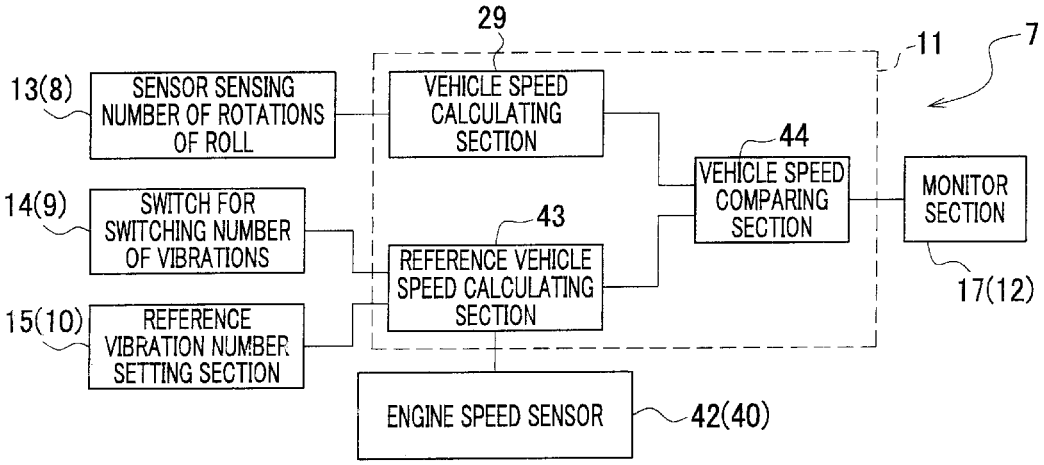

The apparatus for managing degree of compaction according to the second embodiment may also include an engine speed sensing means 40 which directly or indirectly senses the engine speed (number of revolutions of the engine), so that in consideration of information concerning the engine speed, accurate vehicle information can be indicated on the indicating means 12 throughout the whole engine speed bands. FIG. 6B shows an instance where the engine speed sensing means 40 is formed by an engine throttle opening degree sensor 41. An electric signal from the engine throttle opening degree sensor 41 is outputted to a reference vehicle speed calculating section 43, and by correcting errors of the electric signal corresponding to the number of vibrations Fs the actual number of vibrations Fs generated at the roll can be obtained. FIG. 6C shows an instance where the engine speed sensing means 40 is formed by an engine speed sensor 42. An electric signal from the engine speed sensor 42 is outputted to a reference vehicle speed calculating section 43, and by correcting errors of the electric signal corresponding to the number of vibrations Fs the actual number of vibrations Fs generated at the roll can be obtained.

Preferred embodiments of the present invention has been described above, in which the vibratory compacting vehicle is a vibratory roller equipped with tire wheels. However, the present invention is applicable to other type vibratory compacting vehicles. It is to be understood that various changes and modifications in shape or layout of each constituent element can be made therein without departing from the spirit and scope of the accompanied claims.

What is claimed is:

1. An apparatus for managing degree of compaction in a vibratory compacting vehicle having a roll to be vibrated comprising:

a vehicle speed sensing means which senses a traveling speed of the vehicle;

a vibration number setting means by which a number of vibrations of the roll transmitted per unit time is set;

a reference vibration number setting means by which a reference number of vibrations of the roll transmitted per unit of longitudinal travel of the vehicle is set;

a control means controlling electric signals outputted from the vehicle speed sensing means, the vibration number setting means, and the reference vibration number setting means, respectively; and an indicating means relatively and comparatively indicating, as a vehicle speed index value, magnitude relation of a current number of vibrations of the roll transmitted per unit of longitudinal travel of the vehicle relative to the reference number of vibrations of the roll transmitted per unit of longitudinal travel of the vehicle on the basis of an electric signal outputted from the control means.

2. An apparatus for managing degree of compaction in a vibratory compacting vehicle according to claim 1, wherein said control means includes:

a vibration number calculating section calculating an electric signal outputted from the vehicle speed sensing means and an electric signal outputted from the vibration number setting means to work out a current number of vibrations of the roll transmitted per unit of longitudinal travel of the vehicle; and a vibration number comparing section comparatively calculating the current number of vibrations of the roll transmitted per unit of longitudinal travel of the vehicle that is calculated by the vibration number calculating section and the reference number of vibrations of the roll transmitted per unit of longitudinal travel of the vehicle that is set by the reference vibration number setting means.

3. An apparatus for managing degree of compaction in a vibratory compacting vehicle according to claim 1, wherein said control means includes:

a vehicle speed calculating section calculating an electric signal outputted from the vehicle speed sensing means to work out a current vehicle speed;

a reference vehicle speed calculating section calculating an electric signal outputted from the vibration number setting means and an electric signal outputted from the reference vibration number setting means to work out a reference vehicle speed; and a vehicle speed comparing section comparatively calculating the current vehicle speed worked out by the vehicle speed calculating section and the reference vehicle speed worked out by the reference vehicle speed calculating section.

4. An apparatus for managing degree of compaction in a vibratory compacting vehicle according to claim 1, further comprising a non-volatile memory which stores the reference number of vibrations of the roll transmitted per unit of longitudinal travel of the vehicle to be set by the reference vibration number setting means.

5. An apparatus for managing degree of compaction in a vibratory compacting vehicle according to claim 2, further comprising a non-volatile memory which stores the reference number of vibrations of the roll transmitted per unit of longitudinal travel of the vehicle to be set by the reference vibration number setting means.

6. An apparatus for managing degree of compaction in a vibratory compacting vehicle according to claim 3, further comprising a non-volatile memory which stores the reference number of vibrations of the roll transmitted per unit of longitudinal travel of the vehicle to be set by the reference vibration number setting means.

7. An apparatus for managing degree of compaction in a vibratory compacting vehicle according to claim 1, further comprising an engine speed sensing means which directly or indirectly senses a number of revoltions of an engine mounted on the vehicle, and wherein said control means controls an electric signal outputted from the engine speed sensing means.

8. An apparatus for managing degree of compaction in a vibratory compacting vehicle according to claim 2, further comprising an engine speed sensing means which directly or indirectly senses a number of revolutions of an engine mounted on the vehicle, and wherein said control means controls an electric signal outputted from the engine speed sensing means.

9. An apparatus for managing degree of compaction in a vibratory compacting vehicle according to claim 3, further comprising an engine speed sensing means which directly or indirectly senses a number of revolutions of an engine mounted on the vehicle, and wherein said control means controls an electric signal outputted from the engine speed sensing means.

10. An apparatus for managing degree of compaction in a vibratory compacting vehicle according to claim 4, further comprising an engine speed sensing means which directly or indirectly senses a number of revolutions of an engine mounted on the vehicle, and wherein said control means controls an electric signal outputted from the engine speed sensing means.

* * * * *